US009732983B2

(12) United States Patent
Zeller et al.

(10) Patent No.: US 9,732,983 B2
(45) Date of Patent: Aug. 15, 2017

(54) HOT WATER SERVICE MONITORING

(71) Applicant: Steffes Corporation, Dickinson, ND (US)

(72) Inventors: Austin P. Zeller, Dickinson, ND (US); Thomas P. Steffes, Dickinson, ND (US)

(73) Assignee: Steffes Corporation, Dickinson, ND (US)

( * ) Notice: Subject to any disclaimer, the term of this patent is extended or adjusted under 35 U.S.C. 154(b) by 388 days.

(21) Appl. No.: 14/381,032

(22) PCT Filed: Feb. 28, 2013

(86) PCT No.: PCT/US2013/028147

§ 371 (c)(1),
(2) Date: Aug. 26, 2014

(87) PCT Pub. No.: WO2013/130701

PCT Pub. Date: Sep. 6, 2013

(65) Prior Publication Data

US 2015/0063793 A1 Mar. 5, 2015

Related U.S. Application Data

(60) Provisional application No. 61/605,291, filed on Mar. 1, 2012.

(51) Int. Cl.

| | |
|---|---|
| ***F24H 1/18*** | (2006.01) |
| ***F24H 9/20*** | (2006.01) |
| ***F24D 19/10*** | (2006.01) |

(52) U.S. Cl.

CPC ..... *F24H 9/2021* (2013.01); *F24D 19/1051* (2013.01); *F24H 1/185* (2013.01)

(58) Field of Classification Search

None

See application file for complete search history.

(56) References Cited

U.S. PATENT DOCUMENTS

| | | | |
|---|---|---|---|
| 5,115,491 | A | 5/1992 | Perlman et al. |
| 5,193,138 | A | 3/1993 | Richey et al. |

(Continued)

FOREIGN PATENT DOCUMENTS

| | | | |
|---|---|---|---|
| JP | 2007240091 | A | 9/2007 |
| WO | 9601396 | A1 | 1/1996 |
| WO | 2013130701 | A1 | 9/2013 |

OTHER PUBLICATIONS

International Search Report and Written Opinion of PCT/US2013/028147 mailed Aug. 8, 2013.

*Primary Examiner* — Thor Campbell

(74) *Attorney, Agent, or Firm* — Brian D. Kaul; Westman, Champlin & Koehler, P.A.

(57) ABSTRACT

A system includes a cold water supply, a water heater, a mixing valve, and one or more water use fixtures. The water heater includes a tank, a first temperature sensor configured to output a first temperature signal indicative of a water temperature of water in the tank, a heating device, and a water heater controller configured to control the water heater based on the first temperature signal and an operating temperature setting. The mixing valve outputs a mixed water flow, which is a combination of a hot water flow and a cold water flow, to the water use fixtures. A second temperature sensor outputs a second temperature signal indicative of a water flow temperature of the mixed water flow or the hot water flow, and a system controller selectively deactivates the water heater based on the second temperature signal.

16 Claims, 2 Drawing Sheets

(56) References Cited

U.S. PATENT DOCUMENTS

| | | | | |
|---|---|---|---|---|
| 6,286,764 | B1 * | 9/2001 | Garvey | G05D 7/0635 236/12.12 |
| 6,861,621 | B2 * | 3/2005 | Ghent | F24H 9/2021 219/492 |
| 7,020,386 | B2 * | 3/2006 | Scime | F24F 1/00 392/441 |
| 9,234,679 | B2 * | 1/2016 | Deivasigamani | F24D 17/0026 |
| 9,244,466 | B2 * | 1/2016 | DuPlessis | G05D 23/132 |
| 9,268,342 | B2 * | 2/2016 | Beyerle | G05D 23/1346 |
| 9,316,412 | B2 * | 4/2016 | Giamati | F24H 9/126 |
| 2005/0022542 | A1 | 2/2005 | Sakakibara | |
| 2011/0123179 | A1 | 5/2011 | Roetker et al. | |
| 2011/0259445 | A1 * | 10/2011 | Lum | F16K 31/002 137/468 |
| 2012/0046801 | A1 | 2/2012 | Mori et al. | |
| 2012/0057857 | A1 * | 3/2012 | Kenney | F24H 1/142 392/465 |
| 2013/0180611 | A1 * | 7/2013 | Lum | E03B 1/048 137/625.4 |
| 2013/0240053 | A1 * | 9/2013 | Lum | F16K 31/002 137/115.01 |
| 2014/0229022 | A1 * | 8/2014 | Deivasigamani | G05D 7/0629 700/282 |

* cited by examiner

HOT WATER SERVICE MONITORING

CROSS-REFERENCE TO RELATED APPLICATION

This Application is a Selection 371 National Stage Application of International Application No. PCT/US2013/028147, filed Feb. 28, 2013 and published as WO 2013/130701 A1 on Sep. 6, 2013, in English, which claims the benefit of U.S. Provisional Application Ser. No. 61/605,291, filed Mar. 1, 2012 under 35 U.S.C. §119(e). The contents of which are hereby incorporated by reference in their entirety.

FIELD

Embodiments of the invention relate to monitoring hot water services and providing safety features.

BACKGROUND

Hot water services include systems that provide hot water to water use fixtures, such as faucets, showers and other fixtures. Such systems typically include a water heater that receives a supply of cold water and heats the water to a set temperature. It is often desirable to heat the water in the water heater to a set temperature that is greater than the desired temperature of the water delivered to the fixtures. In this situation, the system typically utilizes a thermostatic or other type of mixing valve that operates to mix a flow of hot water from the water heater with a flow of cold water such that the delivered hot water is at the desired temperature. This has the benefit of providing a larger volume of hot water than that stored in the water heater.

In the event of a failure of the mixing valve to properly meter cold water into the flow of hot water from the water heater, the temperature of the discharged hot water flow from the mixing valve can diverge from the desired water temperature. When an insufficient amount of cold water is metered into the flow of hot water from the water heater, the discharged hot water from the mixing valve will exceed the desired water discharge temperature and could potentially result in a scald injury. In the event that the mixing valve meters more cold water into the flow of hot water from the water heater than is necessary, the discharged flow of hot water will have a temperature that is below the desired discharge temperature.

SUMMARY

Embodiments of the invention are directed to a system configured to provide water service to one or more water use fixtures, and methods of controlling water service to the one or more water use fixtures using the system. Some embodiments of the system include a cold water supply, a water heater, a mixing valve, and one or more water use fixtures. The water heater includes a tank containing a supply of water, a first temperature sensor configured to output a first temperature signal indicative of a water temperature of the water in the tank, a heating device configured to heat the water in the tank, and a water heater controller configured to control the water heater based on the first temperature signal and an operating temperature setting. The mixing valve is configured to receive a hot water flow from the tank of the water heater and a cold water flow from the cold water supply, and output a mixed water flow, which is a combination of the hot water flow and the cold water flow. The one or more water use fixtures are configured to receive the mixed water flow. In some embodiments, the system includes a second temperature sensor configured to output a second temperature signal indicative of a water flow temperature of the mixed water flow or the hot water flow, and a system controller configured to deactivate the water heater when the second temperature signal indicates that the water flow temperature exceeds a discharge temperature range.

In some embodiments, the system controller is configured to output an override signal. In some embodiments, the water heater controller deactivates the heating device or lowers the operating temperature setting responsive to the override signal. In some embodiments, the water heater comprises a power supply configured to power the heating device, and the power supply terminates the supply of power to the heating device responsive to the override signal.

In some embodiments, the second temperature is indicative of the temperature of the mixed water flow. In some embodiments, the second temperature is indicative of the temperature of the hot water flow.

In some embodiments, the mixing valve is a thermostatic mixing valve.

In some embodiments, the system comprises memory that includes the discharge temperature range. The system controller is configured to access the discharge temperature range from the memory and compare the water flow temperature to the discharge temperature range.

Some embodiments of the method are directed to controlling water service to one or more water use fixtures by a water system comprising a water heater configured to output a hot water flow from a tank, and a mixing valve configured to output a mixed water flow, which is a combination of the hot water flow and a cold water flow. In some embodiments, a first temperature signal indicative of a temperature of the mixed water flow or the hot water flow is generated using a first temperature sensor. The temperature indicated by the first temperature signal is determined to exceed a discharge temperature range using a system controller. A heating device of the water heater is deactivated using the system controller. The temperature of the hot water flow is reduced responsive to deactivating the heating device.

In some embodiments, the determination that the temperature indicated by the first temperature signal exceeds a discharge temperature range involves accessing the discharge temperature range from memory using the system controller, and comparing the temperature indicated by the first temperature signal to the discharge temperature range using the system controller.

In some embodiments, the water heater comprises a water heater controller that controls the heating device to maintain the temperature of the water in the tank within an operating temperature range responsive to an operating temperature setting. In some embodiments of the method, the heating device is deactivated by lowering the operating temperature setting using the system controller. In some embodiments, the system controller provides an override signal to the water heater controller, which lowers the operating temperature setting responsive to the override signal.

In some embodiments, the heating device of the water heater is deactivated in response to an override signal generated by the system controller. In some embodiments, the water heater comprises a power supply that is configured to power the heating device. In some embodiments, the power supplied to the heating device by the power supply is terminated in response to the override signal from the system controller.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the Background.

DETAILED DESCRIPTION OF ILLUSTRATIVE EMBODIMENTS

Figure 1:
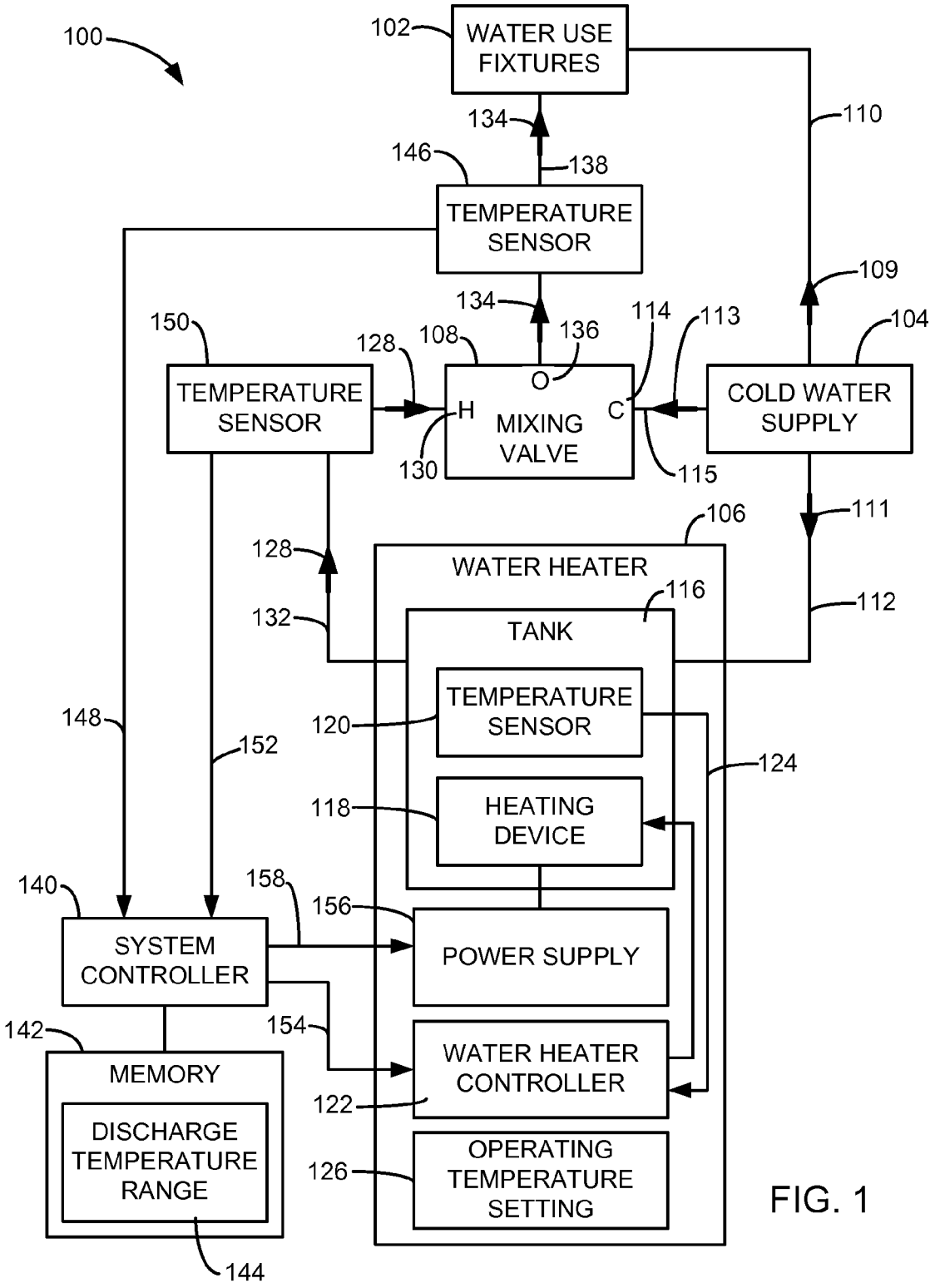
FIG. 1 is a simplified diagram of a system for providing water service in accordance with embodiments of the invention.

Embodiments of the invention are described more fully hereinafter with reference to the accompanying drawings. The various embodiments of the invention may, however, be embodied in many different forms and should not be construed as limited to the embodiments set forth herein. Rather, these embodiments are provided so that this disclosure will be thorough and complete, and will fully convey the scope of the invention to those skilled in the art. Elements that are identified using the same or similar reference characters refer to the same or similar elements.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

It will be understood that when an element is referred to as being "connected" or "coupled" to another element, it can be directly connected or coupled to the other element or intervening elements may be present. In contrast, if an element is referred to as being "directly connected" or "directly coupled" to another element, there are no intervening elements present.

It will be understood that, although the terms first, second, etc. may be used herein to describe various elements, these elements should not be limited by these terms. These terms are only used to distinguish one element from another. Thus, a first element could be termed a second element without departing from the teachings of the present invention.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

As will further be appreciated by one of skill in the art, the present invention may be embodied as methods, systems, and/or computer program products. Accordingly, the present invention may take the form of an entirely hardware embodiment, an entirely software embodiment or an embodiment combining software and hardware aspects. Furthermore, the present invention may take the form of a computer program product on a computer-usable storage medium having computer-usable program code embodied in the medium. Any suitable computer readable medium may be utilized including hard disks, CD-ROMs, optical storage devices, or magnetic storage devices.

The computer-usable or computer-readable medium may be, for example but not limited to, an electronic, magnetic, optical, electromagnetic, infrared, or semiconductor system, apparatus, device, or propagation medium. More specific examples (a non-exhaustive list) of the computer-readable medium would include the following: an electrical connection having one or more wires, a portable computer diskette, a random access memory (RAM), a read-only memory (ROM), an erasable programmable read-only memory (EPROM or Flash memory), an optical fiber, and a portable compact disc read-only memory (CD-ROM). Note that the computer-usable or computer-readable medium could even be paper or another suitable medium upon which the program is printed, as the program can be electronically captured, via, for instance, optical scanning of the paper or other medium, then compiled, interpreted, or otherwise processed in a suitable manner, if necessary, and then stored in a computer memory.

The invention is also described using flowchart illustrations and block diagrams. It will be understood that each block (of the flowcharts and block diagrams), and combinations of blocks, can be implemented by computer program instructions. These program instructions may be provided to a controller comprising a processor circuit, such as a microprocessor, microcontroller or other processor, such that the instructions which execute on the processor(s) create means for implementing the functions specified in the block or blocks. The computer program instructions may be executed by the processor(s) to cause a series of operational steps to be performed by the processor(s) to produce a computer implemented process such that the instructions which execute on the processor(s) provide steps for implementing the functions specified in the block or blocks.

Accordingly, the blocks support combinations of means for performing the specified functions, combinations of steps for performing the specified functions and program instruction means for performing the specified functions. It will also be understood that each block, and combinations of blocks, can be implemented by special purpose hardware-based systems which perform the specified functions or steps, or combinations of special purpose hardware and computer instructions.

FIG. 1 is a simplified diagram of a system 100 for providing water service in accordance with embodiments of the invention. Valves and other details of the system 100 are not shown in order to simplify the drawing. The system 100 operates to provide both cold and hot water to water use fixtures 102, which may include faucets, showers, and other water use fixtures. In one embodiment, the system 100 includes a cold water supply 104, a water heater 106 and a thermostatic or other suitable mixing valve 108. The cold water supply 104 provides a cold water flow 109 to the water use fixtures 102 through line 110, a cold water flow 111 to the water heater 106 through line 112, and a cold water flow 113 to a cold water inlet 114 of the mixing valve 108 through line 115.

The water heater 106 can be a conventional water heater that is configured to heat a supply of water to an operating temperature or within an operating temperature range between high and low operating temperature bounds. In some embodiments, the water heater 106 includes a tank 116, a heating device 118, a temperature sensor 120, and a water heater controller 122. The tank 116 is configured to hold a volume of water. The heating device 118 is a conventional water heating device that is configured to heat the water in the tank 116. The temperature sensor 120 generates a temperature signal 124 that is indicative of the temperature of the water contained in the tank 116. The water heater controller 122, which may include one or more processors, monitors the temperature of the water in the tank 116 using the temperature signal 124. The water heater controller 122 controls the heating device 118 to maintain the temperature of the water in the tank at the desired operating temperature, or within the operating temperature range set by an operating temperature setting 126. The operating temperature setting 126 may be set in accordance with conventional techniques.

When the temperature of the water in the tank 116 drops below the operating temperature, or drops below a low temperature bound of the operating temperature range, the water heater controller 122 activates the heating device 118 to heat the water in the tank 116. When the water in the tank 116 reaches the set temperature, or exceeds a high temperature bound, the water heater controller 122 deactivates the heating device 118. In this manner, the water heater controller 122 operates to maintain the temperature of the water in the tank 116 at the desired operating temperature, or within the desired operating temperature range corresponding to the operating temperature setting 126. The term "operating temperature" as used hereinafter, will refer to a temperature or temperature range set based on the operating temperature setting 126. The set temperature may be determined based on a user setting in accordance with conventional water heaters 106.

In some embodiments, a hot water flow 128 of the heated water in the tank 116 is delivered to a hot water inlet 130 of the mixing valve 108 through a line 132. In some embodiments, the mixing valve 108 meters the cold water flow 113 received at the inlet 114 into the hot water flow 132 received at the inlet 130, and outputs a mixed water flow 134 through the outlet 136, which is provided to the water use fixtures 102 through line 138. The mixing of the cold water flow 113 with the hot water flow 128 allows the temperature of the water in the tank 116 to exceed a desired temperature of the mixed water flow that is to be delivered to the water use fixtures 102, provided that the mixing valve 108 and/or the water heater 106 are functioning properly. As mentioned above, this allows the system 100 to effectively expand its supply of hot water.

Embodiments of the system 100 include a system controller 140. In some embodiments, the system controller 140 includes one or more processors that are configured to access and execute program instructions stored in memory 142 or other location to carry out method steps and functions described herein. In some embodiments, the system controller 140 monitors the temperature of the mixed water flow 134 output through the outlet 136, and/or the hot water flow 128 output from the water heater 106, and provides an override in the heating of the water in the tank 116 in the event that the flow 134 or the flow 128 exceeds a discharge temperature range due to a malfunction of the mixing valve 108 or the water heater 106, for example. As used herein, the term "discharge temperature range" may indicate a threshold temperature or a range of temperatures spanning upper and lower bounds. When temperatures of both the mixed water flow 134 and the hot water flow 128 are monitored, the discharge temperature range may include a separate threshold temperature or temperature range for each of the flows. The discharge temperature range is set using conventional hardware and/or software components. In some embodiments, the discharge temperature range is stored in memory 142, as indicated by box 144, or other location that is accessible by the system controller 140.

In some embodiments, the system 100 includes a temperature sensor 146 that is configured to output a temperature signal 148 that is indicative of the temperature (hereinafter "mixed flow temperature") of the mixed water flow 134, and/or a temperature sensor 150 that is configured to output a temperature signal 152 that is indicative of the temperature (hereinafter "hot flow temperature") of the hot water flow 128. The temperature sensors 146 and 150 may be conventional temperature sensors. While illustrated as separate components, the temperature sensors 146 and 150 and the system controller 140 may be combined into a single component, such as an aquastat or other device.

In some embodiments, the controller 140 compares the mixed flow temperature indicated by the signal 148, and/or the hot flow temperature indicated by the signal 152, to the discharge temperature range. In some embodiments, the system controller 140 accesses the discharge temperature range 144 from the memory 142 and compares the range 144 to the temperatures indicated by the signals 148 and/or 152.

When the water heater 106 and the mixing valve 108 are operating properly, the temperatures of the mixed water flow 134 and the hot water flow 128 are within the corresponding discharge temperature ranges. In that case, the system controller 140 allows the water heater 106 to maintain the water in the tank 116 at the relatively high operating temperature. That is, the water heater 106 and the mixing valve 108 are allowed to operate in accordance with conventional hot water systems.

However, if the system controller 140 determines that the temperature signal 148 indicates that the mixed flow temperature exceeds the discharge temperature range, or that the temperature signal 152 indicates that the hot flow temperature exceeds the discharge temperature range, the system controller 140 deactivates the heating device 118 of the water heater 106. The deactivation of the heating device 118 allows the water in the tank 116 to cool.

In some embodiments, the system controller 140 deactivates the heating device 118 by sending an override signal 154 to the water heater controller 122. The water heater controller 122 deactivates the heating device 118 in response to the signal 154. In some embodiments, the water heater 106 includes a power supply 156 that is configured to supply power to the heating device 118 using conventional techniques. In some embodiments, the water heater controller 122 controls the power supply 156 of the water heater 106 to terminate the supply of power to the heating device 118, which deactivates the heating device 118, in response to the signal 154. In some embodiments, the power supply 156 terminates the supply of power to the heating device 118 responsive to a signal 158 from the system controller 140.

In some embodiments, the override signal 154 operates to lower the operating temperature setting 126 of the water heater 106 to a guarding temperature (or range). In some embodiments, the guarding temperature is set to a temperature that reduces or eliminates the potential for scald injuries from the mixed water flow 134 by users of the fixtures 102. In one embodiment, the guarding temperature is set to a temperature that is within the discharge temperature range. The reduction in the operating temperature setting 126 of the water heater 106 to the guard temperature causes the water heater controller 122 to deactivate the heating device 118 and prevent the heating of the water in the tank 116 until the temperature of the water contained within the tank 116 drops below the guard temperature.

In some embodiments, the system controller 140 does not immediately react when the temperature of the mixed water flow 134 or the hot water flow exceeds the discharge temperature range. Rather, the system controller 140 continues to monitor the temperature of the mixed water flow 134 or the hot water flow 128 for a predetermined period of time before deactivating the heating device 118 in accordance with one of the techniques described above. This delay allows for minor fluctuations in the temperature of the water flows 134 or 128 to occur without disturbing the operation of the water heater 106. In some embodiments, this delay is incorporated in the discharge temperature range by having a sufficiently wide range to accommodate foreseeable fluctuations in the temperatures of the flow 134 or the flow 128.

In some embodiments, if the temperature of the mixed hot water flow 134 indicated by the signal 148, or the temperature of the hot water flow 128 indicated by the signal 152, drops below the discharge temperature range, the system controller 140 activates the heating device 118. In some embodiments, this activation of the heating device 118 is performed responsive to a signal 154 from the system controller 140 to the water heating controller 122. Here, the signal 154 may cause the water heating controller 122 to activate the heating device 118, raise the operating temperature setting, and/or allow the power supply 156 to supply power to the heating device 118. In some embodiments, the power supply 156 provides power to the heating device 118 to activate the heating device 118 responsive to a signal 158 from the system controller 140.

Figure 2:
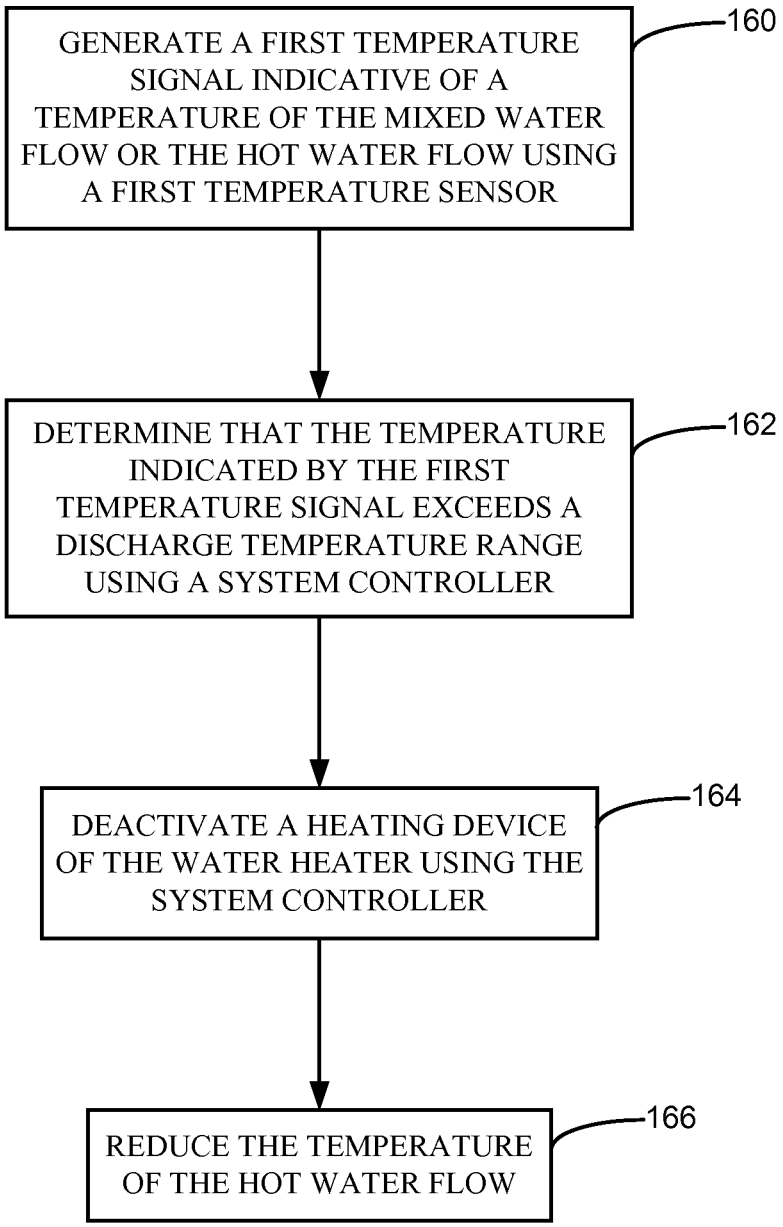
FIG. 2 is a flowchart illustrating a method of controlling water service to one or more water use fixtures in accordance with embodiments of the invention.

FIG. 2 is a flowchart illustrating a method of controlling water service to one or more water use fixtures 102 in accordance with embodiments of the invention. In some embodiments, the method uses the system 100 formed in accordance with one or more embodiments described above to perform the method. In some embodiments, the system 100 includes a water heater 106 configured to output a hot water flow 128 from a tank 116, and a mixing valve 108 configured to output a mixed water flow 134, which is a combination of the hot water flow 128 and a cold water flow 113. At 160 of the method, a first temperature signal (148 or 152) indicative of a temperature of the mixed water flow 134 or the hot water flow 128 using a first temperature sensor (146 or 150), as described above with reference to FIG. 1. At 162, the temperature indicated by the first temperature signal is determined to exceed a discharge temperature range (144) using a system controller 140. At 164, a heating device 118 of the water heater 106 is deactivated using the system controller 140. At 166, the temperature of the hot water flow 128 is reduced responsive to deactivating the heating device 118.

In some embodiments of step 162, the discharge temperature range 144 is accessed from memory 142 using the system controller 140. The temperature indicated by the first temperature signal (148 or 152) is compared to the discharge temperature range 144 using the system controller 140.

In some embodiments, the water heater 106 includes a water heater controller 122 that controls the heating device 118 to maintain the temperature of the water in the tank 116 within an operating temperature range responsive to an operating temperature setting 126. In some embodiments of step 164, the heating device is deactivated by lowering the operating temperature setting 126 using the system controller 140. In some embodiments, this lowering of the operating temperature setting 126 occurs responsive to an override signal 154 from the system controller 140.

In some embodiments of the deactivating step 164, the system controller 140 provides an override signal 154, which causes the deactivation of the heating device 118. In some embodiments, the override signal 154 is provided to the water heater controller 122, which responsively deactivates the heating device 118.

In some embodiments, the water heater comprises a power supply 156 that supplies power to the heating device 118. In some embodiments of the deactivating step 164, the system controller 140 provides an override signal 158 to the power supply 156, which responsively terminates the supply of power to the heating device 118 to deactivate the heating device 118. In some embodiments, the system controller 140 provides the override signal 154 to the water heater controller 122, which controls the power supply to terminate the supply of power to the heating device 118.

In some embodiments, the system controller 140 determines that the temperature indicated by the first temperature signal (148 or 152) is less than the discharge temperature range. In some embodiments, the system controller 140 activates the heating device 118 to heat the water in the tank 116. In some embodiments, the heating device 118 is activated until the water in the tank 116 is within the discharge temperature range.

Although the present invention has been described with reference to preferred embodiments, workers skilled in the art will recognize that changes may be made in form and detail without departing from the spirit and scope of the invention.

What is claimed is:

1. A system configured to provide water service to one or more water use fixtures, the system comprising:

a cold water supply;

a water heater comprising:

a tank containing a supply of water;

a first temperature sensor configured to output a first temperature signal indicative of a water temperature of the water in the tank;

a heating device configured to heat the water in the tank; and a water heater controller configured to control the water heater based on the first temperature signal and an operating temperature setting;

a mixing valve configured to receive a hot water flow from the tank of the water heater and a cold water flow from the cold water supply, and output a mixed water flow, which is a combination of the hot water flow and a cold water flow;

one or more water use fixtures configured to receive the mixed water flow;

a second temperature sensor configured to output a second temperature signal indicative of a water flow temperature of the mixed water flow or the hot water flow; and a system controller configured to lower the operating temperature setting when the second temperature signal indicates that the water flow temperature exceeds a discharge temperature range.

2. A system according to claim 1, wherein:

the system controller is configured to output an override signal to the water heater controller; and the water heater controller deactivates the heating device or lowers the operating temperature setting responsive to the override signal.

3. A system according to claim 1, wherein:

the system controller is configured to output an override signal;

the water heater comprises a power supply configured to power the heating device; and the power supply terminates the supply of power to heating device responsive to the override signal.

4. A system according to claim 1, wherein the second temperature signal is indicative of the temperature of the mixed water flow.

5. A system according to claim 1, wherein the second temperature signal is indicative of the temperature of the hot water flow.

6. A system according to claim 1, wherein the mixing valve is a thermostatic mixing valve.

7. A system according to claim 1, wherein:

the system comprises memory including the discharge temperature range; and the system controller is configured to access the discharge temperature range from the memory and compare the water flow temperature to the discharge temperature range.

8. A method of controlling water service to one or more water use fixtures by a system comprising a water heater and a mixing valve, the water heater including a water heater controller that controls a heating device to maintain a temperature of water in a tank within an operating temperature range responsive to an operating temperature setting, the water heater configured to output a hot water flow from the tank, the mixing valve configured to output a mixed water flow, which is a combination of the hot water flow and a cold water flow, the method comprising:

generating a first temperature signal indicative of a temperature of the mixed water flow or the hot water flow using a first temperature sensor;

determining that the temperature indicated by the first temperature signal exceeds a discharge temperature range using a system controller;

lowering the operating temperature setting using the system controller; and reducing the temperature of the hot water flow responsive to lowering the operating temperature setting.

9. A method according to claim 8, wherein determining that the temperature indicated by the first temperature signal exceeds a discharge temperature range comprises:

accessing the discharge temperature range from memory using the system controller; and comparing the temperature indicated by the first temperature signal to the discharge temperature range using the system controller.

10. A method according to claim 8, wherein lowering an operating temperature setting of the water heater using the system controller comprises:

providing an override signal to the water heater controller using the system controller; and lowering the operating temperature setting responsive to providing an override signal.

11. A method according to claim 8, further comprising:

monitoring the first temperature signal using the system controller;

providing an override signal to a water heater controller of the water heater using the system controller when the first temperature signal indicates that the temperature of the mixed water flow exceeds the discharge temperature range for a predetermined period of time; and deactivating the heating device of the water heater responsive to providing an override signal.

12. A method according to claim 8, wherein deactivating a heating device of the water heater comprises:

providing an override signal using the system controller; and terminating a supply of power to the heating device from a power supply responsive to providing an override signal.

13. A method according to claim 8, wherein the first temperature signal is indicative of the temperature of the hot water flow.

14. A method according to claim 8, wherein the first temperature signal is indicative of the temperature of the mixed water flow.

15. A method according to claim 8, further comprising:

determining that the temperature indicated by the first temperature signal is less than the discharge temperature range using the system controller;

activating the heating device using the system controller responsive to determining that the temperature is less than a lower discharge temperature bound; and heating the water in the tank responsive to activating the heating device.

16. A method according to claim 8, wherein the mixing valve is a thermostatic mixing valve.

* * * * *